US008613446B2

(12) United States Patent
Miyake et al.

(10) Patent No.: US 8,613,446 B2
(45) Date of Patent: Dec. 24, 2013

(54) SHEET STACKING APPARATUS

(75) Inventors: Toshiyuki Miyake, Abiko (JP); Mitsuhiko Sato, Kashiwa (JP); Naoto Watanabe, Abiko (JP); Takayuki Fujii, Tokyo (JP); Yushi Oka, Abiko (JP); Takashi Yokoya, Kashiwa (JP); Hiromasa Maenishi, Matsudo (JP); Yutaka Ando, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 156 days.

(21) Appl. No.: 12/814,338

(22) Filed: Jun. 11, 2010

(65) Prior Publication Data

US 2010/0320679 A1 Dec. 23, 2010

(30) Foreign Application Priority Data

Jun. 18, 2009 (JP) ..... 2009-145447

(51) Int. Cl.
*B65H 39/10* (2006.01)

(52) U.S. Cl.
USPC ..... 271/299; 271/279; 271/298; 271/287

(58) Field of Classification Search
USPC ..... 271/279, 298–300, 287; 101/408–412, 101/483, 484
See application file for complete search history.

(56) References Cited

U.S. PATENT DOCUMENTS

| | | | | |
|---|---|---|---|---|
| 7,954,818 | B2 * | 6/2011 | Fukatsu et al. | 271/300 |
| 2008/0054557 | A1 * | 3/2008 | Hayashi et al. | 271/279 |
| 2008/0054558 | A1 * | 3/2008 | Obuchi et al. | 271/298 |
| 2010/0148421 | A1 * | 6/2010 | Tachibana | 271/3.17 |

FOREIGN PATENT DOCUMENTS

JP 2009-012924 A 1/2009

* cited by examiner

*Primary Examiner* — Prasad Gokhale
(74) *Attorney, Agent, or Firm* — Canon USA Inc. IP Division

(57) ABSTRACT

A sheet stacking apparatus includes a stack unit which includes a first stack tray and a second stack tray which can be individually elevated and is configured to stack a sheet on at least one of the first stack tray and the second tray, and a control unit configured to control the stack unit to stack the sheet in a first stack mode in which the sheet is stacked on at least one of the first stack tray and the second stack tray without being extended over the first stack tray and the second stack tray and a second stack mode in which the sheet is stacked on across the first stack tray and the second stack tray, the control unit capable of selecting the first stack mode and the second stack mode with respect to a same size sheet.

10 Claims, 14 Drawing Sheets

SHEET STACKING APPARATUS

BACKGROUND OF THE INVENTION

1. Field of the Invention

The present invention relates to a sheet stacking apparatus which includes a plurality of stack trays.

2. Description of the Related Art

In recent years, an image forming apparatus such as a printer and a copying machine has increased in an image forming speed due to advancement in an image forming technique, so that the apparatus can discharge a large amount of sheets in a high speed. Accordingly, a sheet stacking apparatus (hereinafter referred to as a stacker apparatus) which is connected to the image forming apparatus and stacks sheets discharged therefrom is demanded to have large capacity. To meet the demand, a large-capacity stacker apparatus is discussed in which several thousands of sheets discharged from an image forming apparatus can be vertically stacked on a stack tray.

U.S. Patent Application No. 2008/0054558 discusses a stacker apparatus which includes two stack trays arranged side by side, in which A4-size small sheets are stacked on both a left and right stack trays and A3-size large sheets are stacked on across the left and right stack trays (i.e., the two trays). The above stacker apparatus enables a more significant increase in the maximum stack capacity of the small-size sheet with a stack space maintained as it is than a conventional stacker apparatus in which sheets are stacked on a single stack tray without regard to a sheet size and enables an effective use of the stack space.

In the conventional stacker apparatus, the amount of sheets stacked on the stack tray is restricted by a height of stacked sheets. For this reason, if a sheet high in density such as coated paper (which is thin in thickness but heavy in weight) is stacked on a single stack tray to the height by which the amount of sheets to be stacked is restricted, drive torque of a motor for elevating the stack tray may be insufficient. This resultantly causes a problem that a stack operation cannot be continued.

The stacker apparatus discussed in U.S. Patent Application No. 2008/0054558 can ensure a certain amount of a stack capacity by distributing sheets on two stack trays with the number of sheets to be stacked on each stack tray being restricted. Since some users want a configuration of stacking sheets in one column with consideration for workability in the post process, distribution of the sheets on the two stack trays can decrease usability.

Further, the output of a driving motor may be increased and a ratio of a gear for transmitting drive may be changed to avoid a shortage of the drive torque of the motor for elevating the stack tray. This, however, may bring about the disadvantage such as an increase in the cost of the driving motor, and a decrease in usability due to reduction in the elevation speed of the stack tray because of the change of a gear ratio.

SUMMARY OF THE INVENTION

The present invention is directed to a sheet stacking apparatus which includes two trays arranged side by side and can stack a plurality of sheets which are large in grammage without using a powerful motor and deteriorating workability after sheets are stacked. Further, the present invention relates to a sheet stacking apparatus which includes two trays arranged side by side and can stack a plurality of sheets to facilitate transportation of the sheets after being stacked.

According to an aspect of the present invention, a sheet stacking apparatus includes a stack unit which includes a first stack tray and a second stack tray which can be individually elevated and is configured to stack a sheet on at least one of the first stack tray and the second tray, and a control unit configured to control the stack unit to stack the sheet in a first stack mode in which the sheet is stacked on at least one of the first stack tray and the second stack tray without being extended over the first stack tray and the second stack tray and a second stack mode in which the sheet is stacked on across the first stack tray and the second stack tray, the control unit capable of selecting the first stack mode and the second stack mode with respect to a same size sheet.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
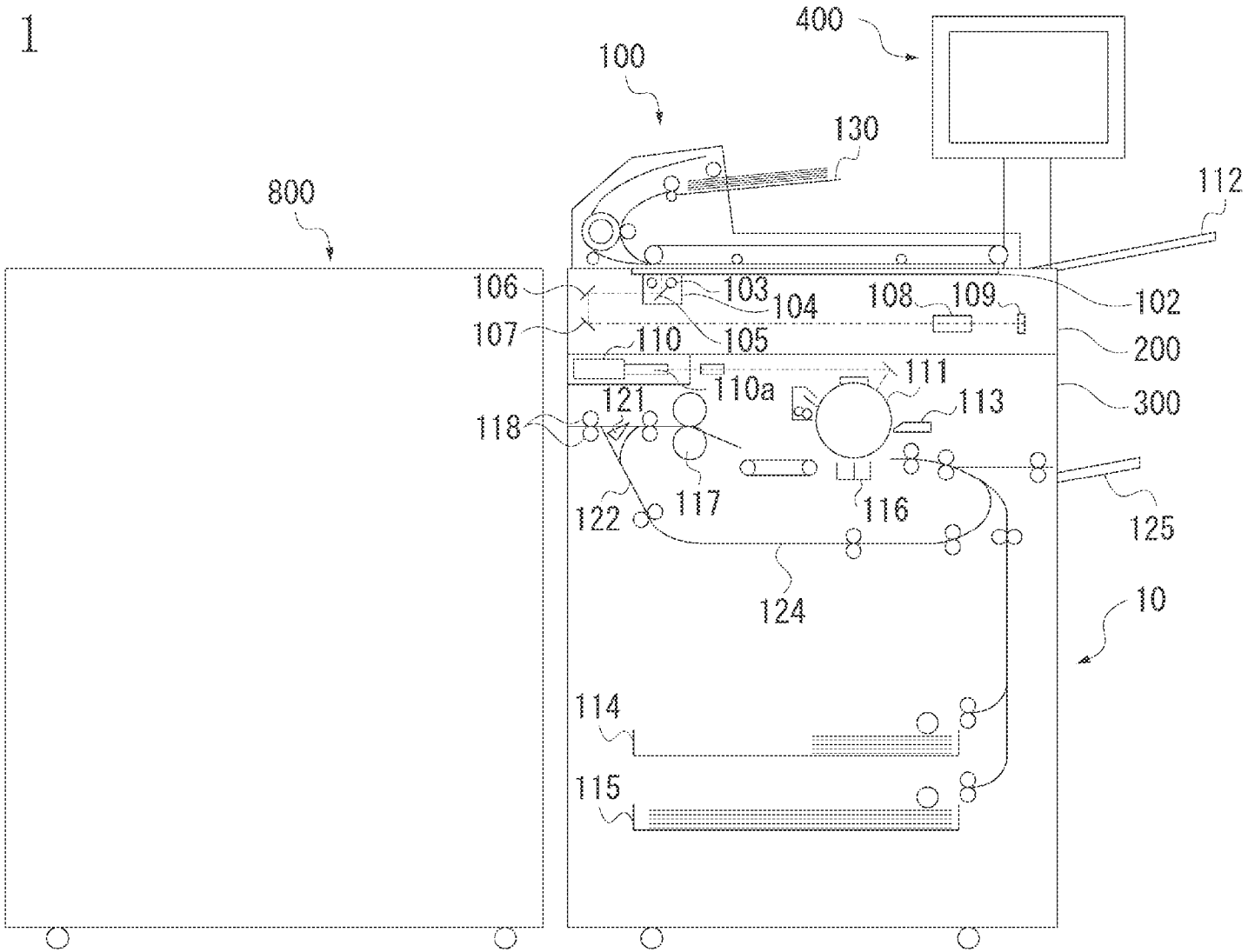
FIG. 1 is a general schematic diagram of an image forming system.

FIG. 1 is a vertical cross sectional view of a principal portion of an image forming system according to a first exemplary embodiment. As illustrated in FIG. 1, the image forming system according to the present exemplary embodiment includes an image forming apparatus 10 and a stacker 800. The image forming apparatus 10 includes an image reader 200 and a printer 300.

The image reader 200 is equipped with a document feeding apparatus 100. The document feeding apparatus 100 feeds a document sheet pointing upward and placed on a document tray 130 one by one sequentially from the top page, conveys the document sheet on a platen glass 102 through a curved path from left to right in the figure via a predetermined reading position, and then discharges the document sheet to a discharge tray 112 on the outside. An image on the document sheet is read by a scanner unit 104 supported at the predetermined reading position when the document sheet passes the predetermined reading position on the platen glass 102 from left to right. Such a method of reading a document is generally referred to as a document flow reading. More specifically, a document surface to be read is irradiated with light of a lamp 103 in the scanner unit 104 when the document passes the predetermined reading position, and the light reflected from the document is led to a lens 108 through mirrors 105, 106, and 107. The light passing the lens 108 forms an image on an imaging plane of an image sensor 109.

Image data output from the image sensor 109 is subjected to predetermined processing at an image signal control unit 202 described below and then output to an exposure unit 110 of the printer 300 as a video signal.

The exposure unit 110 of the printer 300 outputs a laser beam modulated based on the input video signal. The laser beam is deflected by a polygonal mirror 110*a* to scan a photosensitive drum 111. An electrostatic latent image is formed on the photosensitive drum 111 according to the scanning laser beam. The electrostatic latent image on the photosensitive drum 111 is visualized as a developer image by a developer supplied from a development unit 113. A sheet is fed from a cassette 114 or 115, a manual feed unit 125, or a two-side conveyance path 124 in synchronization with the start of irradiation with the laser beam and conveyed between the photosensitive drum 111 and a transfer unit 116. The developer image formed on the photosensitive drum 111 is transferred to the sheet by the transfer unit 116.

The sheet to which the developer image is transferred is conveyed to a fixing unit 117. The fixing unit 117 heats and presses the sheet to fix the developer image on the sheet. The sheet passing the fixing unit 117 is discharged from the printer 300 to the stacker 800 via a flapper 121 and a discharge roller 118.

The image forming apparatus according to the present exemplary embodiment is capable of forming an image on a two-sided sheet. The detailed description thereof is omitted.

Figure 2:
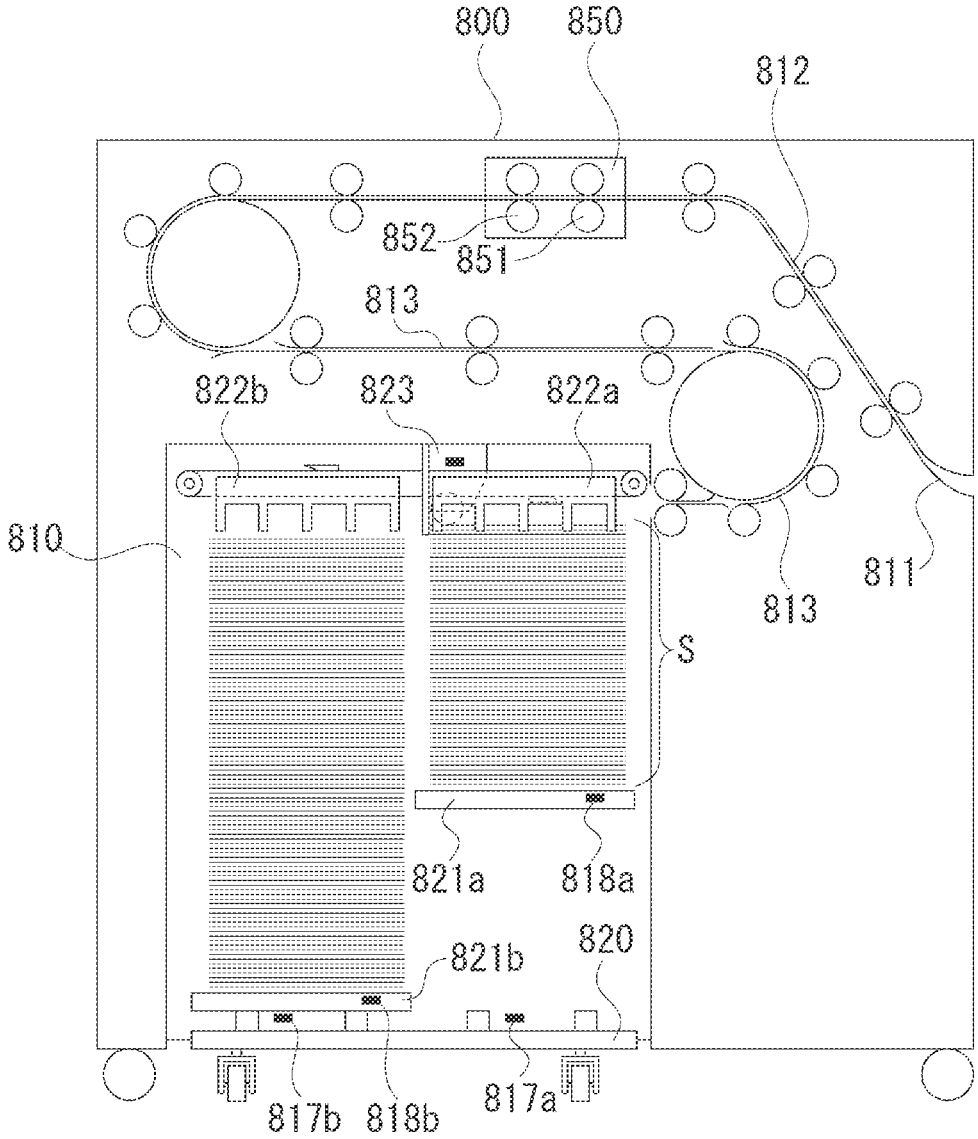
FIG. 2 is a cross sectional view of a stacker apparatus.

A configuration of the stacker 800 is described below with reference to FIG. 2. FIG. 2 is a schematic diagram of the stacker 800 in FIG. 1. Stack trays 821*a* and 821*b* being a first and a second stack tray are ones for sequentially receiving the sheets discharged from the image forming apparatus 10 and stacking a large number of sheets thereon and are elevated independently by motors 841*a* and 841*b* (not shown). Sheet positioning members 822*a* and 822*b* position the sheet in back and forth directions in FIG. 2. A leading edge sheet positioning unit 823 positions the sheet in a direction in which the sheet is conveyed. The sheet positioning members 822*a* and 822*b*, and the leading edge sheet positioning unit 823 are individually driven by motors (not shown) to improve loading property of sheets on the stack trays 821*a* and 821*b*. A reference numeral without a subscript a or b refers to one with both subscripts a and b.

The sheet discharged from the image forming apparatus 10 is drawn into the stacker 800 through a conveyance path 811 at a sheet inlet. A conveyance path 812 conveys the sheet to the stack tray 821 of the stacker 800. The stacker 800 can operate in a shift sorting mode in which the sheet is discharged to the stack tray 821 with the sheet offset halfway across the conveyance path 812. A lateral registration correction device 850 as a shift conveyance unit is provided in which the sheet is conveyed while being shifted in a width direction to a predetermined position in the shift sorting mode. The lateral registration correction device 850 corrects the lateral registration of all the sheets discharged to the stack tray 821 in the shift sorting mode and conveys the sheets while shifting sheets in the width direction to the predetermined position.

The sheet subjected to the lateral registration correction by the lateral registration correction device 850 is led to a stack unit 810 through a conveyance path 813.

Full stack position detection sensors 817*a* and 817*b* detect that the stack trays 821*a* and 821*b* descend to a full stack position. When the full stack position detection sensors 817*a* and 817*b* detect that the stack trays 821*a* or 821*b* descend to the full stack position, the sheets are interrupted to be conveyed to the stack tray detected in being fully loaded. The full stack position detection sensor 817*a* corresponds to the stack tray 821*a* and the full stack position detection sensor 817*b* corresponds to the stack tray 821*b*. A lower limit position (take-out position) of the stack tray 821 lies in a position lower by a predetermined distance than a position where the full stack position detection sensor 817 detects the stack tray 821 (full stack detection position).

Sheet presence or absence detection sensors 818*a* and 818*b* are used to determine whether the sheet is stacked on the stack trays 821*a* or 821*b*. The sheet presence or absence detection sensor 818*a* corresponds to the stack tray 821*a* and the sheet presence or absence detection sensor 818*b* corresponds to the stack tray 821*b*.

When a sheet is discharged from the image forming apparatus 10, information about a size of the discharged sheet is transmitted in advance from a central processing unit (CPU) 151, which is described below, to a stacker control unit 801. The stacker control unit 801 shifts the sheet positioning member 822 and the leading edge sheet positioning unit 823 according to the sheet size information to allow the sheets to be sequentially stacked in an aligned state.

The leading edge sheet positioning unit 823 includes a sheet surface detection sensor 816, a knurled belt 824, and a stopper 825 and is shifted in a conveyance direction by a motor (not shown) according to a length of the sheet to be stacked on the stack tray 821 or a stack mode.

The sheet surface detection sensor 816 is attached to the leading edge sheet positioning unit 823 and detects a top surface of a stacker sheet bundle stacked on the stack tray 821. A tray elevating motor 841 is controlled based on an output of the sheet surface detection sensor 816 to keep the stack tray 821 in a sheet receiving position while sheets are being stacked on the stack tray 821.

The knurled belt 824 is rotated clockwise by a motor (not shown), leads the sheet to be conveyed between the knurled belt 824 and the stack tray 821, causes a leading edge thereof to abut on the stopper 825, and stacks the sheet on the stack tray 821. The knurled belt 824 is fixed so as to abut on the topmost surface of the sheet when the stack tray 821 is in the sheet receiving position.

A gripper 830 conveys the sheet while gripping the leading edge thereof. The gripper 830 is attached to a drive belt 831 in a state in which the gripper 830 is pressed by a spring (not shown) in a direction to close an inlet of the gripper 830. The inlet of the gripper 830 is opened by a driving apparatus (not shown). The drive belt 831 is rotated clockwise by a motor (not shown). The drive belt 831 is driven with the gripper 830 gripping the leading edge of the sheet to convey the sheet from the outlet of the conveyance path 813 onto the stack trays 821*a* or 821*b*.

A dolly 820 transports the stack tray 821 on which sheets are stacked thereon. Thee dolly 820 is equipped with four casters attached to each of four corners of its bottom face. The dolly 820 can be pulled out of the stacker 800 to transport the sheet bundle. When the sheet bundle is taken out of the stack trays 821*a* or 821*b* on which the sheet bundle is stacked, the stack trays 821*a* and/or 821*b* are lowered by the motors 841*a* and 841*b* for elevating the tray. Further, the stack trays are stopped at the lower limit position which is lower by a predetermined distance than a position where the full stack position detection sensors 817*a* or 817*b* detects the stack tray.

A door of the stacker 800 is opened with the stack tray 821 stopped in the lower limit position and the dolly 820 is pulled out, so that the sheet bundle together with the lowered stack tray 821 can be transported. When the sheet bundle is taken out of either the stack trays 821*a* or 821*b*, one stack tray is lowered and transported by the dolly 820. In this case, the other stack tray is left in the stack unit 810 and the dolly 820 is not attached to the stack unit 810, however, the sheet can be stacked.

Figure 3:
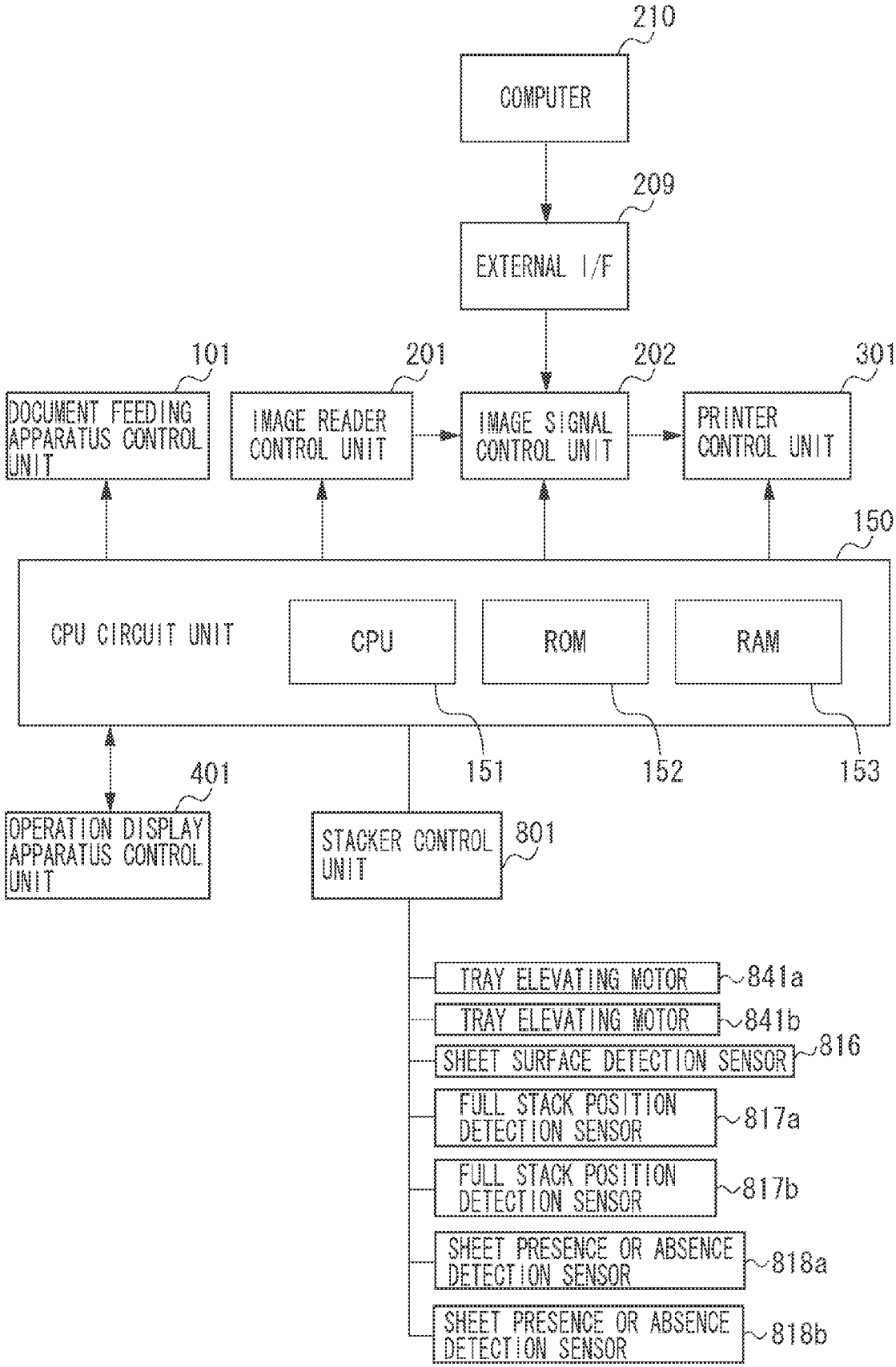
FIG. 3 is a control block diagram illustrating an image forming system.

The control of the entire image forming system is described below with reference to FIG. 3. FIG. 3 is a block diagram illustrating the control of the entire image forming system illustrated in FIG. 1.

A CPU circuit unit 150 serving as a control unit includes a CPU 151, a read-only memory (ROM) 152, and a random access memory (RAM) 153. A control program stored in the ROM 152 totally controls blocks 101, 201, 202, 209, 301, 401, and 801. The RAM 153 temporarily stores control data and is used as a work area for arithmetic processing required for control.

A document feeding apparatus control unit 101 drives and controls the document feeding apparatus 100 based on an instruction from the CPU 151. An image reader control unit 201 drives and controls the above described scanner unit 104 and image sensor 109 and transfers an analog image signal output from the image sensor 109 to an image signal control unit 202.

The image signal control unit 202 converts the analog image signal output from the image sensor 109 to a digital signal, subjects the digital signal to various types of processing, converts the digital signal to a video signal, and outputs the video signal to a printer control unit 301. The image signal control unit 202 subjects a digital image signal input from a computer 210 via an external interface (I/F) 209 to various types of processing, converts the digital video signal to a video signal, and outputs the video signal to the printer control unit 301. The processing operation of the image signal control unit 202 is controlled by the CPU 151. The printer control unit 301 drives the above described exposure unit 110 based on the input video signal.

An operation display apparatus control unit 401 transmits and receives information to and from an operation display apparatus 400 and the CPU 151. The operation display apparatus 400 includes a plurality of keys for setting various functions related to image formation and a display unit for displaying various pieces of information. The operation display apparatus 400 outputs a key signal corresponding to an operation of each key to the CPU 151 and displays information on a display unit based on a signal from the CPU 151.

A stacker control unit 801 is mounted on the stacker 800 and transmits and receives information to and from the CPU 151 to drive and control the entire stacker. Control contents of the stacker control unit 801 are described below.

Figure 4:
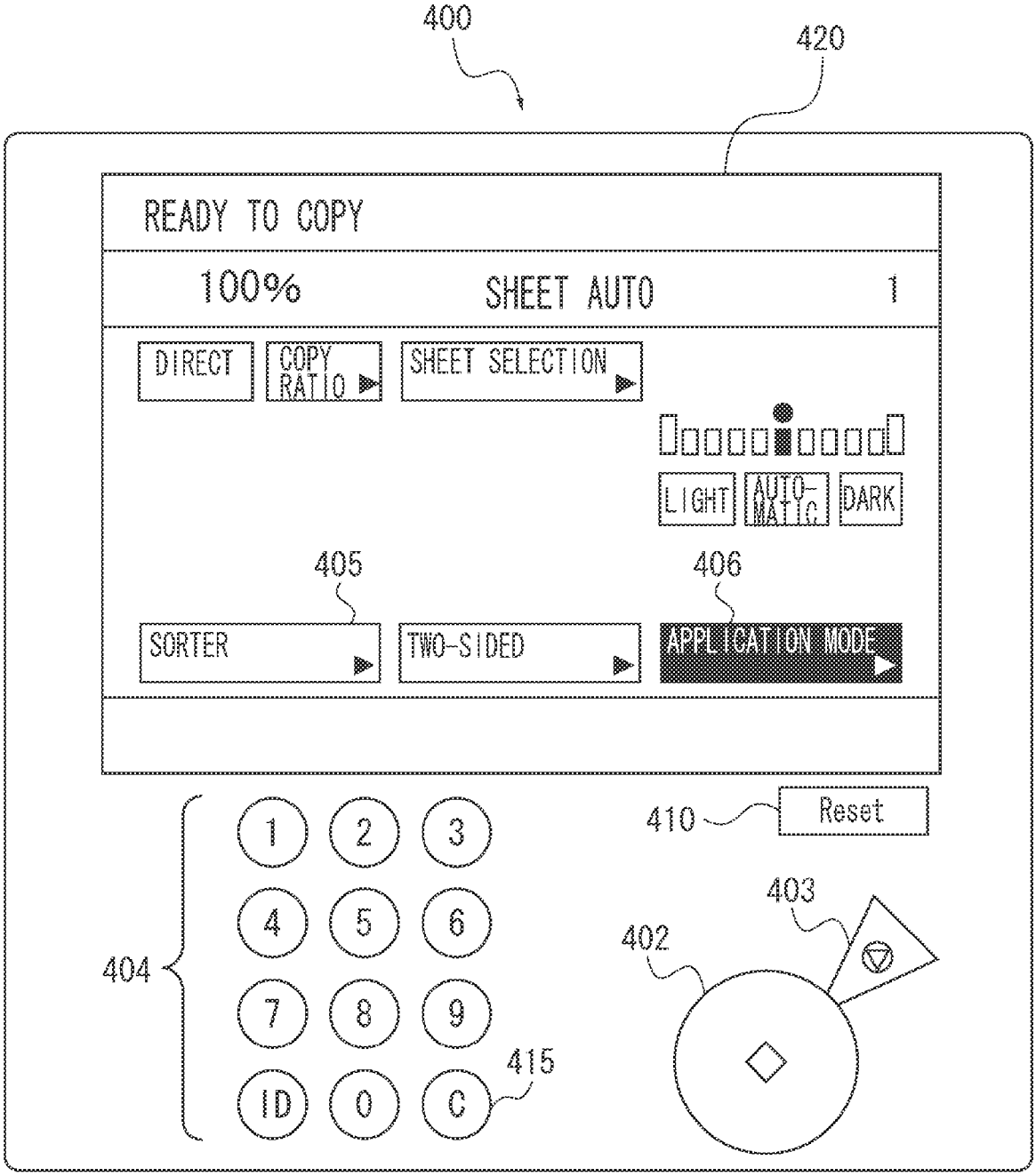
FIG. 4 illustrates an operation display apparatus.

FIG. 4 illustrates the operation display apparatus 400 of the image forming apparatus in FIG. 1.

The operation display apparatus 400 includes a start button 402 for starting an image forming operation, a stop key 403 for stopping the image forming operation, a numeric keypad group 404 for setting the number of copies or the like, a clear key 415, and a reset key 410. The operation display apparatus 400 further includes a application mode key 406 for various settings including the setting of stack preference described below. A liquid crystal display unit 420 on which a touch panel is formed is arranged on the upper part of the operation display apparatus 400 and a soft key can be formed on the screen thereof.

The image forming apparatus according to the present invention has various post-processing modes such as non-sorting, group sorting, and shift sorting. Such processing modes can be set by operation input from the operation display apparatus 400. When a post-processing mode is set, for example, a "sorter" key 405 provided as the soft key is selected on an initial screen illustrated in FIG. 4 to display a menu selection screen on the display unit 420. The menu selection screen is used to set the processing modes.

A basic operation of the stacker 800 is described below. Before a sheet S is conveyed from the image forming apparatus 10 to the stacker 800, the CPU 151 determines a size and material of the sheet to select one of two stack modes described below and notifies the stacker control unit 801 of the selected stack mode. The stacker control unit 801 performs stack control of the sheet according to the stack mode of which the stacker control unit 801 is notified. In other words, the CPU 151 functions as a control unit that selects the stack mode and issues an instruction to the stacker 800.

The details of selection of the stack mode are described below. When a sheet with a length less than 230 mm in the conveyance direction is stacked, the stacker 800 stacks the sheet on one tray without extending the sheet over the stack trays 821*a* and 821*b* (a first stack mode, refer to FIG. 9A). When a sheet with a length of 230 mm or more in the conveyance direction is stacked, the below described stack preference is designated, or conveyance of a sheet of a specific material is set, the stacker 800 stacks the sheet on across the stack trays 821*a* and 821*b* (a second stack mode, refer to FIG. 9B). In the second stack mode, the stack trays 821*a* and 821*b* are controlled to be lifted or lowered in synchronization with the position and the speed of both trays.

In the execution of the first stack mode, the stacker 800 stacks the sheet on the stack tray 821*b* first, and when the full stack position detection sensor 817*b* detects that the stack tray 821*b* descends to the full stack position, the stacker 800 stacks the sheet on the stack tray 821*a*.

Figure 5A:
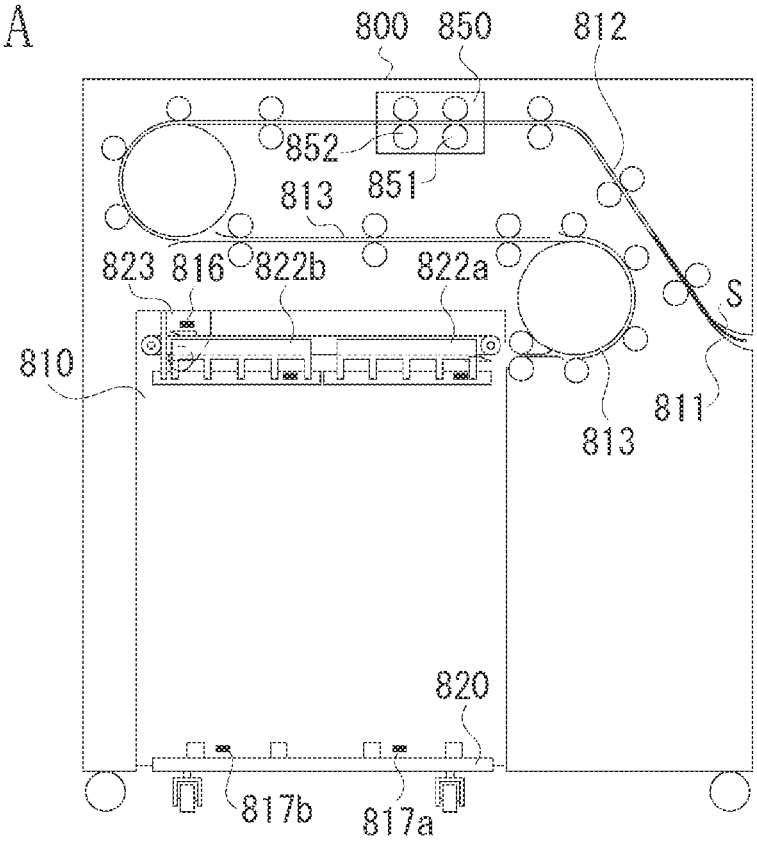
FIGS. 5A and 5B illustrate a state where a sheet is conveyed in the stacker apparatus.

In order that the sheet is stacked on the stack tray 821*b* first, the leading edge sheet positioning unit 823 is previously moved to an upper part of the stack tray 821*b* and stands by before the sheet is started to be conveyed (refer to FIG. 5A). As illustrated in FIG. 5A, the sheet S discharged from the image forming apparatus 10 is conveyed to the conveyance path 811 of the stacker 800 and further conveyed inside the stacker apparatus by a roller pair attached to the conveyance path 811.

Figure 5B:
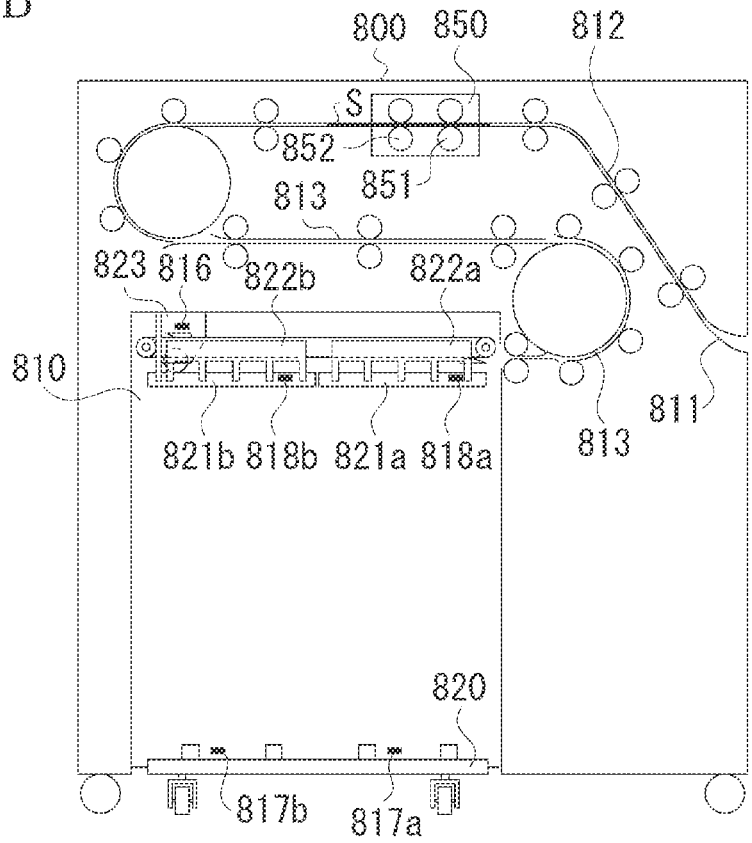

The lateral registration of the sheet S is corrected by the lateral registration correction device 850. As illustrated in FIG. 5B, conveyance rollers 851 and 852 incorporated in the lateral registration correction device 850 are moved by a motor (not shown) in a sheet-width direction orthogonal to the conveyance direction with the sheet held between the conveyance rollers 851 and 852 to shift the sheet. The lateral registration correction device 850 detects an edge portion of the sheet by a sensor (not shown) and moves the conveyance rollers 851 and 852 so that the position of the edge portion of the sheet reaches a predetermined position, thereby correcting displacement of lateral registration of the sheet. If the above mentioned shift sorting mode is set, the lateral registration correction device 850 shifts sheets in units of the number of copies in the width direction (on a forward side or on a back side of the apparatus), so that sheets are offset and stacked in units of the number of copies. In other words, if the shift sorting mode is set, the lateral registration correction device 850 shifts the sheet by adding an amount of movement of the conveyance rollers 851 and 852 for shifting the sheet to the forward side or to the back side to the displacement of lateral registration of the sheet.

Figure 6:
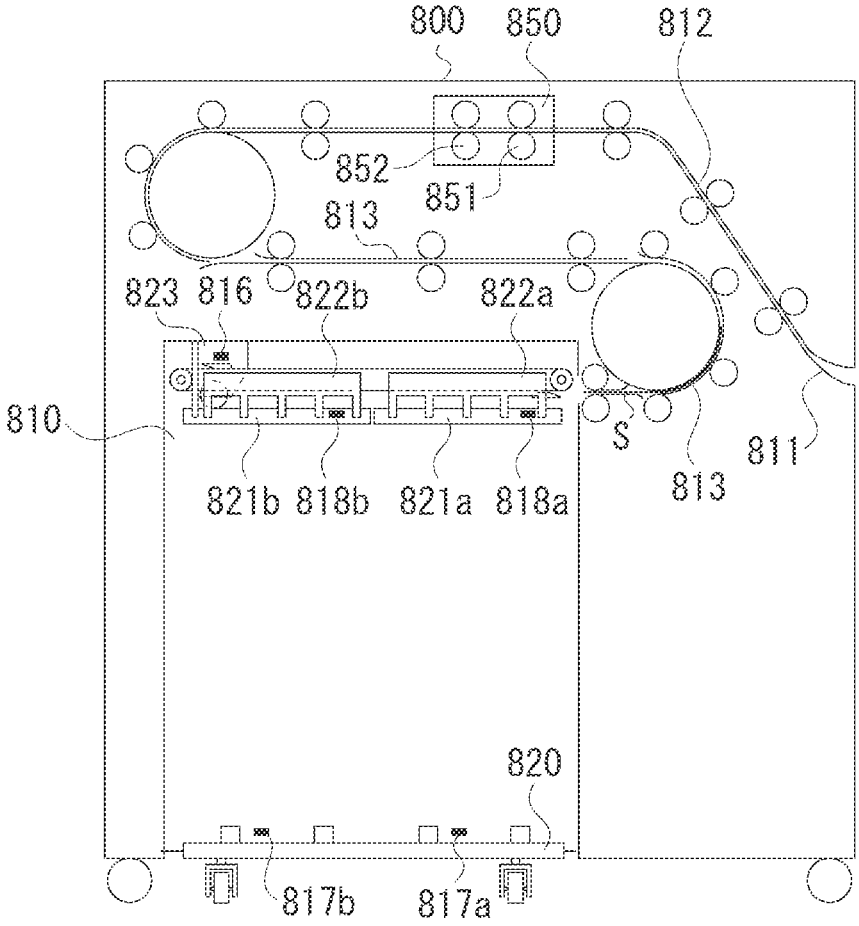
FIG. 6 illustrates a state where a sheet is conveyed in the stacker apparatus.
Figure 7A:
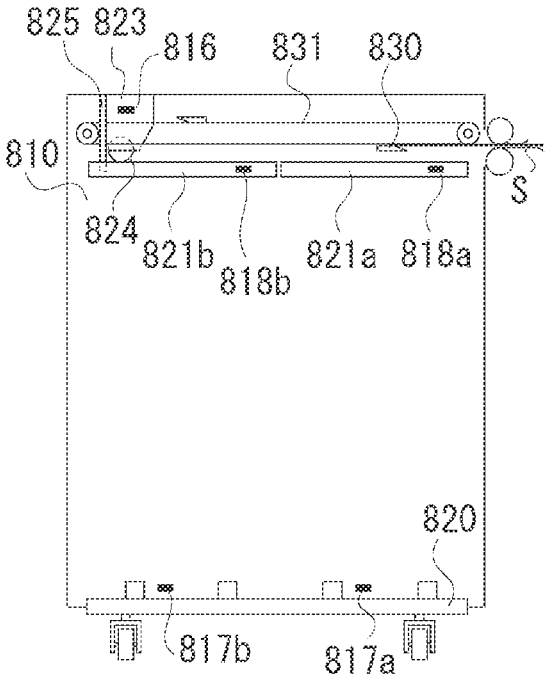
FIGS. 7A to 7D illustrate a state where a sheet is stacked in the stacker apparatus.

As illustrated in FIG. 6, the sheet S is conveyed to the stack unit 810 through the conveyance path 813. The sheet S conveyed to the stack unit 810 is held by the gripper 830 which is on standby. The drive belt 831 is rotated after the sheet S is held to convey the sheet S to the stack tray 821*b* (refer to FIG. 7A).

Figure 7B:
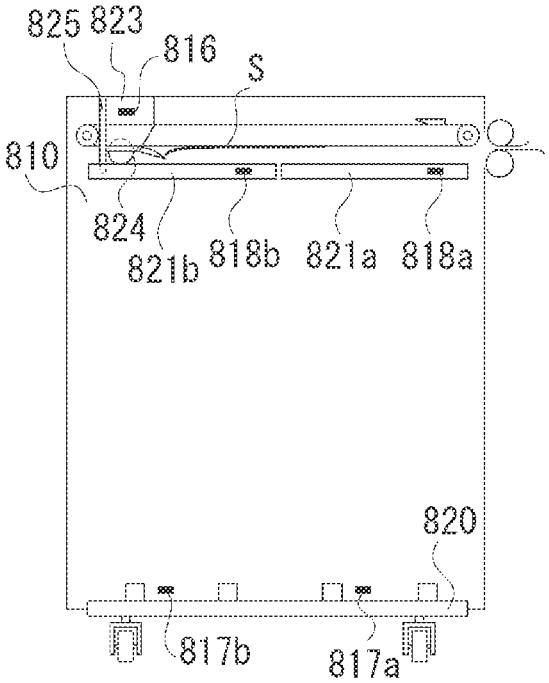
Figure 7C:
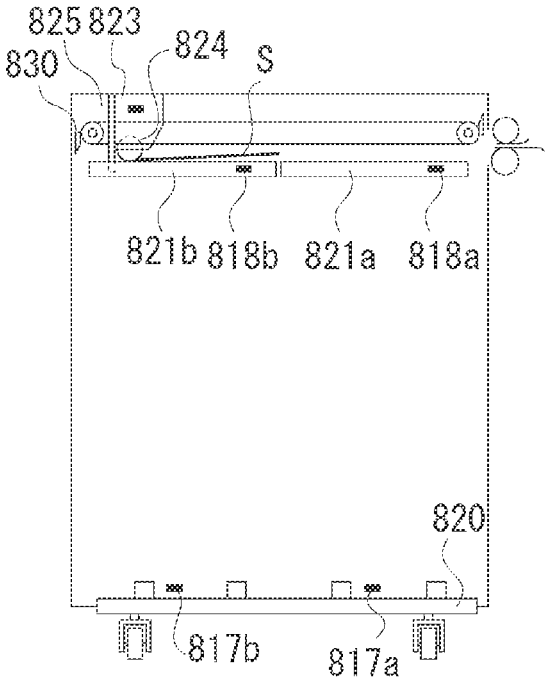
Figure 7D:
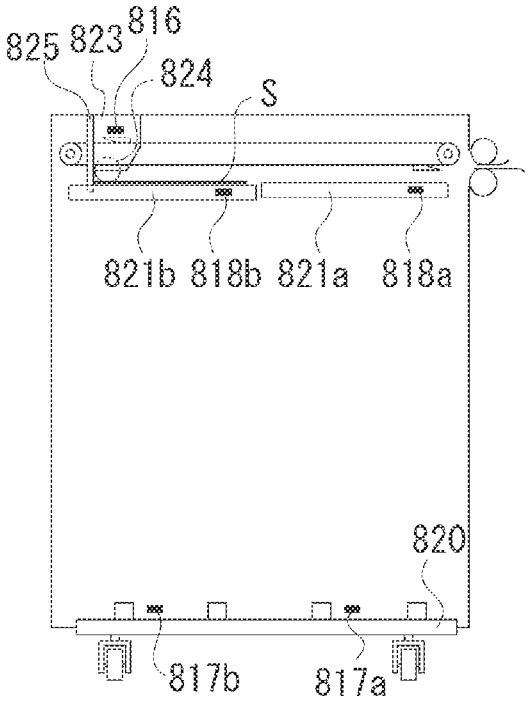

When the sheet S approaches the leading edge sheet positioning unit 823, the inlet of the gripper 830 is opened by a driving apparatus (not shown) to release the sheet S (refer to FIG. 7B). The sheet S falls on the topmost surface of the stack tray 821*b* while traveling with the inertial force in the conveyance direction. Thereafter, the sheet S is conveyed by the knurled belt 824 toward the stopper 825 while sliding on the topmost surface of the stack tray 821*b* (refer to FIG. 7C). As illustrated in FIG. 7D, the sheet S is caused to abut on the stopper 825 by the knurled belt 824 to be stopped. The sheet positioning member 822 for positioning the position of the sheet on the forward side and on the back side of the apparatus aligns the sheets in the width direction of the sheet to align the lateral end of the sheet. After stacking is completed, the stack tray 821*b* is lifted or lowered by a motor (not shown) based on the output of the sheet surface detection sensor 816 to maintain the height of the topmost surface of the stack tray 821*b* constant.

Figure 8A:
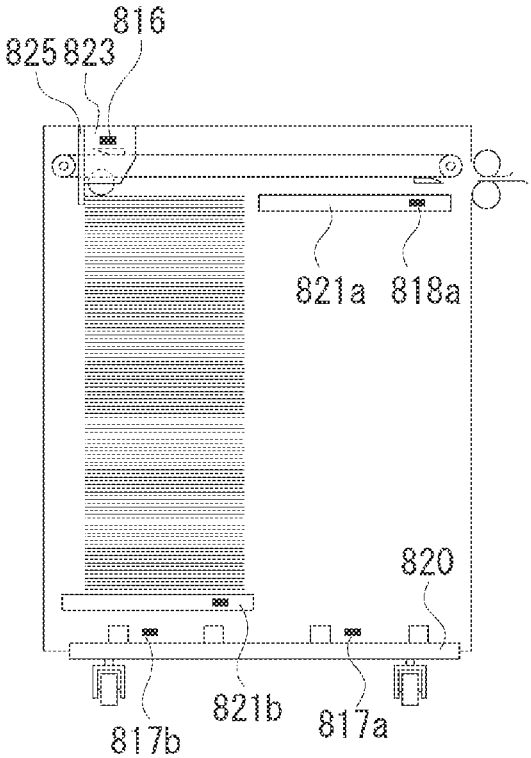
FIGS. 8A to 8D illustrate a state where sheets are stacked in the stacker apparatus.

As illustrated in FIG. 8A, the stack tray 821*b* is gradually lowered according as a plurality of sheets is being stacked on the stack tray 821*b*. When the full stack position detection sensor 817*b* detects that the stack tray 821*b* lowers to the full stack detection position, the stacker 800 determines that the stack tray 821*b* is fully loaded and changes a discharge destination of the sheet from the stack tray 821*b* to the stack tray 821*a*.

Figure 8B:
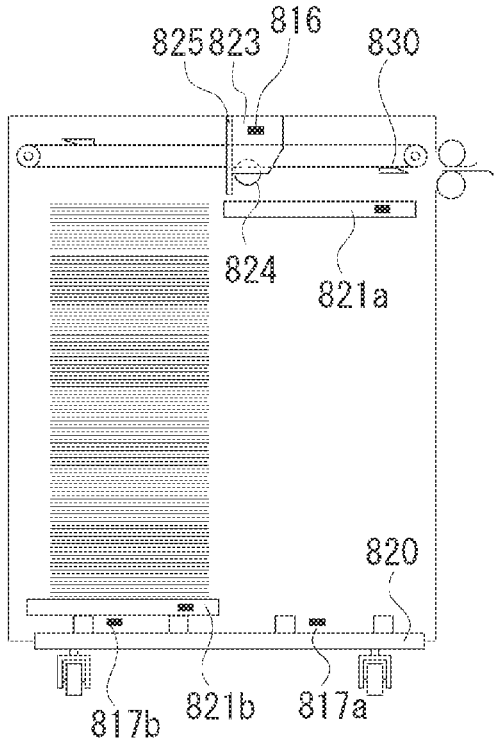
Figure 8C:
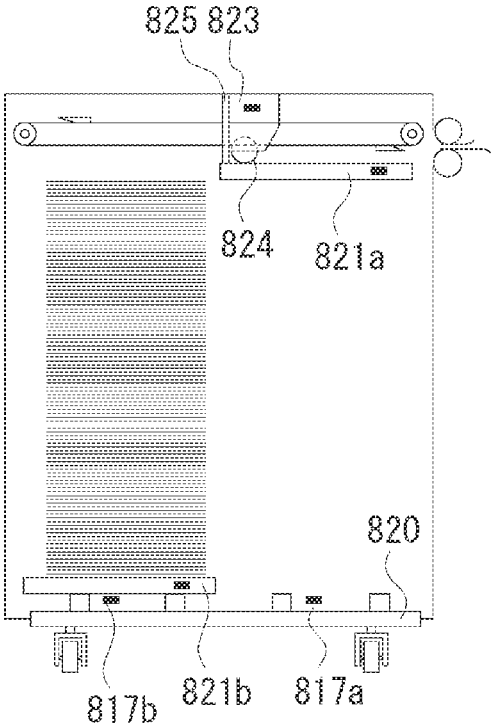

The stacker 800 causes the stack tray 821*b* to lower to a position lower than the full stack detection position and moves the leading edge sheet positioning unit 823 to the upper part of the stack tray 821*a* (refer to FIG. 8B). At this point, as illustrated in FIG. 8B, the topmost surface of the stack tray 821*a* is lowered to a position lower than the bottom surface of the stopper 825. After the movement of the leading edge sheet positioning unit 823 is finished, the stack tray 821*a* is lifted to a position where the topmost surface of the stack tray 821*a* can be detected by the sheet surface detection sensor 816 (refer to FIG. 8C).

Figure 8D:
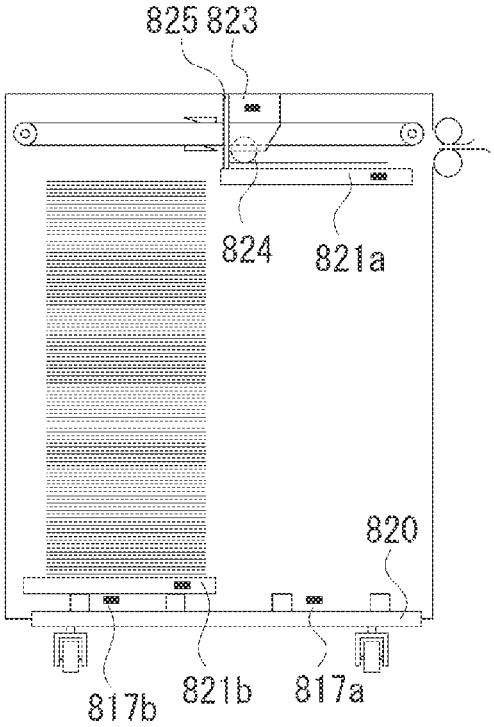
Figure 9A:
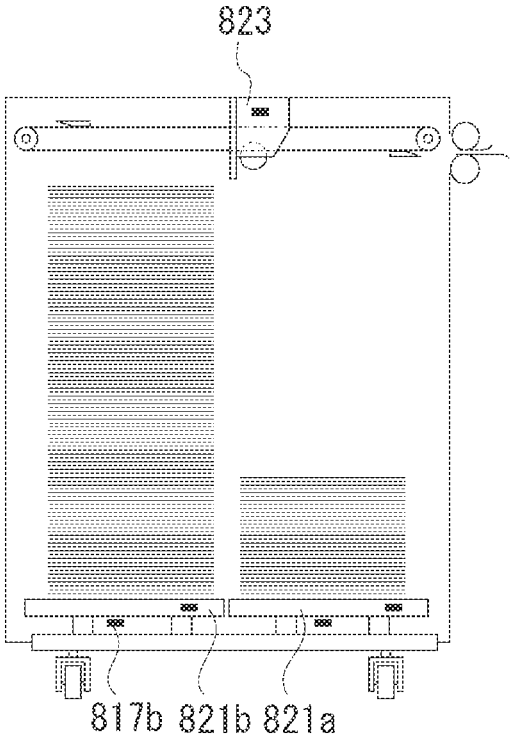
FIGS. 9A to 9C illustrate a state where sheets are stacked in a first and a second stack mode.

When the movement of the leading edge sheet positioning unit 823 is finished and the stack tray 821*a* is lifted to the topmost surface thereof, the sheets are started to be stacked on the stack tray 821*a* (refer to FIG. 8D). A method for stacking sheets on the stack tray 821*a* is similar to that of stacking sheets on the stack tray 821*b*. As illustrated in FIG. 9A, sheets are finally stacked on the stack trays 821*a* and 821*b*.

Figure 9B:
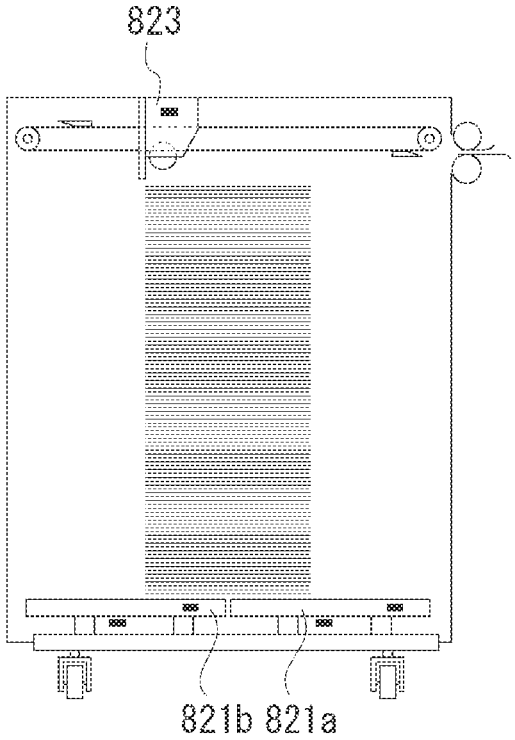

When the second stack mode is executed, the stacker 800 moves the leading edge sheet positioning unit 823 to a position indicated in FIG. 9B. The leading edge of the sheet reaches this position when sheets are stacked almost evenly across the stack trays 821*a* and 821*b*. In other words, the position regulates the leading edge of the sheet so that the center of the stack trays 821*a* and 821*b* agrees with that of the sheet to be stacked.

A method for stacking sheets, thereafter, is similar to that of stacking sheets in the first stack mode. The stacker 800 performs elevation control to maintain both of the stack trays 821*a* and 821*b* at the sheet receiving position based on the output of the sheet surface detection sensor 816. When any of the full stack position detection sensors 817*a* and 817*b* detects the stack trays 821*a* or 821*b*, the stacker 800 determines that the stack tray 821 is fully loaded. The stacker 800 notifies the CPU circuit unit 150 that the stack tray 821 is fully loaded and temporarily stops operating. The image forming apparatus 10 temporarily interrupts the formation of an image on the sheet.

The setting of a stack preference condition is described below. In the present exemplary embodiment, when sheets are stacked in the stack unit 810 of the stacker 800, a user can select whether to prefer stacking a large amount of sheets (a preference for the number of sheets to be stacked) or whether to prefer facilitating transportation by the dolly (a preference for transportability). In other words, the user selects either the first stack mode (a preference for a multitude of the number of sheets to be stacked) or the second stack mode (a preference for transportability) and the stacker 800 switches the control for stacking sheets to the stack unit 810 according to the selected result.

For a sheet with a length less than 230 mm in the conveyance direction, in the first stack mode, the sheets are stacked separately on the stack trays 821*a* and 821*b*, so that a stacking space can be used effectively. In the second stack mode, sheets are stacked on across the stack trays 821*a* and 821*b* at the center thereof. In this case, the center of gravity of the sheet bundle substantially agrees with that of the dolly 820 and the four casters of the dolly 820 are equally loaded, thereby improving stability and operability in transportation. The number of sheets to be stacked in the first stack mode is greater than that in the second stack mode. For this reason, in the second stack mode, the number of necessary sheets is greater than that of sheets to be stacked in one column, the stack operation is required twice or more. The first stack mode is set as default. When a sheet with a length of 230 mm or more in the conveyance direction is stacked or a material for a sheet to be stacked is coated paper, the second stack mode is automatically selected. The material for a sheet to be stacked which is selected in the second stack mode includes not only coated paper, but also a sheet which is not less than a predetermined value in weight per unit area and unit thickness.

Figure 10A:
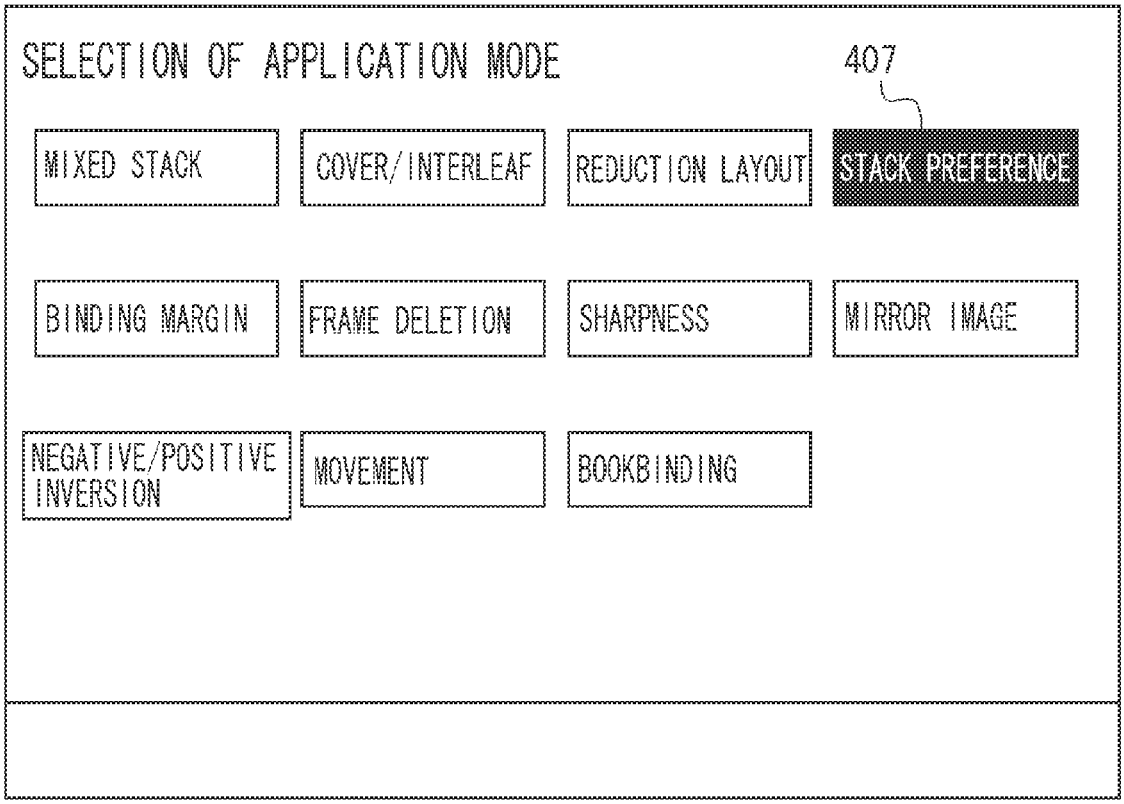
FIGS. 10A to 10B are screens for setting conditions of stack preference.
Figure 10B:
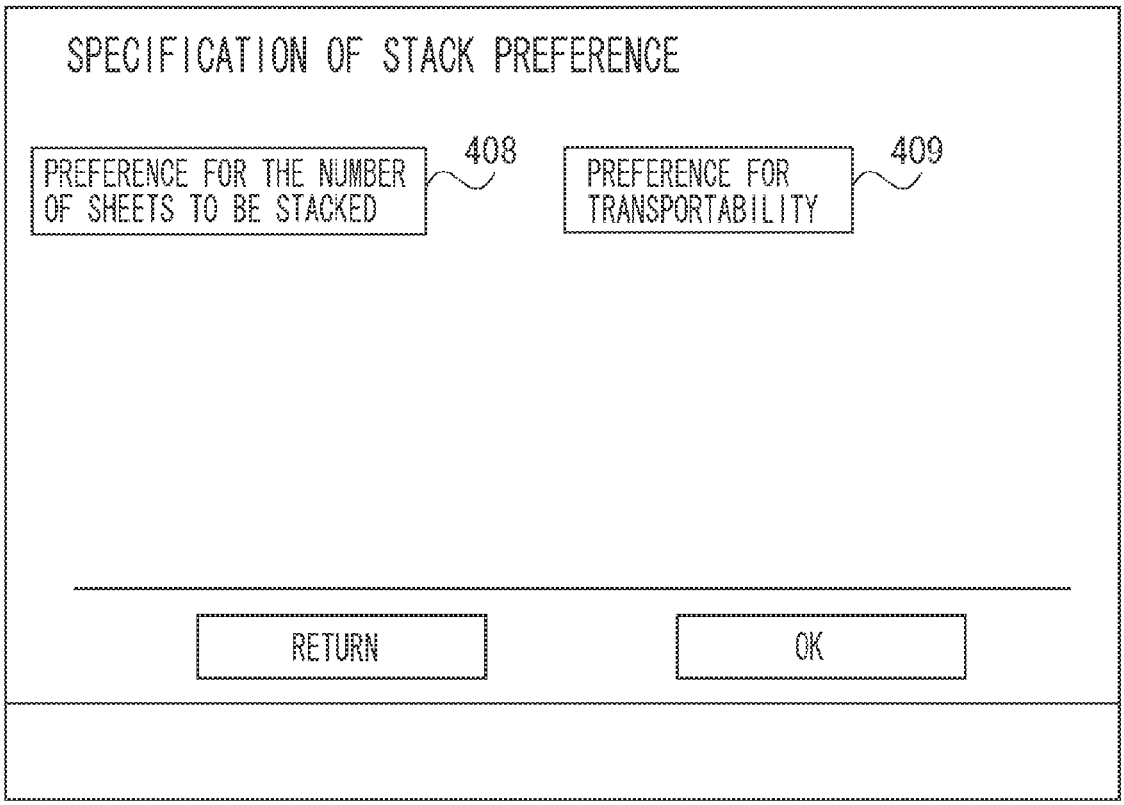

When an "application mode" key 406 on the liquid crystal display unit 420 illustrated in FIG. 4 is depressed, a screen illustrated in FIG. 10A is displayed on the liquid crystal display unit 420. When a "stack preference" key 407 on the screen illustrated in FIG. 10A is depressed, a screen illustrated in FIG. 10B is displayed on the liquid crystal display unit 420. When a "preference for the number of sheets to be stacked" key 408 on the screen illustrated in FIG. 10B is depressed and then an OK key is depressed, the first stack mode ("a preference for the number of sheets to be stacked" mode) is specified. When a "preference for transportability" key 409 is depressed and then the OK key is depressed, the second stack mode ("a preference for transportability" mode) is specified. In other words, the operation display apparatus 400 functions as a preference selection unit configured to select a preference on stacking. The specified information is stored in the RAM 153 in the CPU circuit unit 150.

The selection control of the stack mode is described below using a flow chart illustrated in FIG. 11. Processing illustrated in the flow chart is executed by the CPU 151.

In step S1003, the CPU 151 determines the number of copies and setting of a job such as a two-sided mode which are set by a user and stores various pieces of information such as the set number of copies in the RAM 153. In step S1005, the CPU 151 determines whether "the preference for transportability" mode is set based on the data stored in the RAM 153. If "the preference for transportability" mode is set (YES in step S1005), then in step S1009, the CPU 151 selects the second stack mode as the stack mode. If "the preference for transportability" mode is not set (NO in step S1005), then in step S1006, the CPU 151 determines whether the sheet set by the user is 230 mm or more in length in the conveyance direction. If the sheet is 230 mm or more in length (YES in step S1006), then in step S1009, the CPU 151 selects the second stack mode as the stack mode even if "the preference for the number of sheets to be stacked" mode is set.

If the sheet is less than 230 mm in length (NO in step S1006), then in step S1007, the CPU 151 determines whether the material of the sheet is the coated paper. If the material of the sheet is the coated paper (YES in step S1007), then in step S1009, the CPU 151 selects the second stack mode as the stack mode even if "the preference for the number of sheets to be stacked" mode is set. In other words, the CPU 151 functions as a selection unit for selecting either the first or the second stack mode. The reason the second stack mode is selected in the case where the material of the sheet is the coated paper is described below. The coated paper is greater in weight for its thickness than plain paper, so that if the coated paper is stacked in the first stack mode as is the case with the plain paper which is less than 230 mm in length, a stacked bundle of the coated paper is heavier than that of the plain paper even if stacked heights of both papers are the same. This makes insufficient the torque of the motor for elevating the tray or makes it difficult for the dolly to transport the stacked sheet bundle. Stacking sheets on across the trays 821*a* and 821*b* causes two motors to support the sheet bundle, so that the load per motor can be reduced. As described above, the second stack mode may be selected if a sheet is not less than a predetermined value in weight per unit area and unit thickness in addition to the coated paper. If the material of the sheet is not the coated paper (NO in step S1007), then in step S1008, the CPU 151 selects the first stack mode. The selection of the stack mode can be changed by the time the start button 402 of the operation display apparatus 400 is depressed.

Figure 12A:
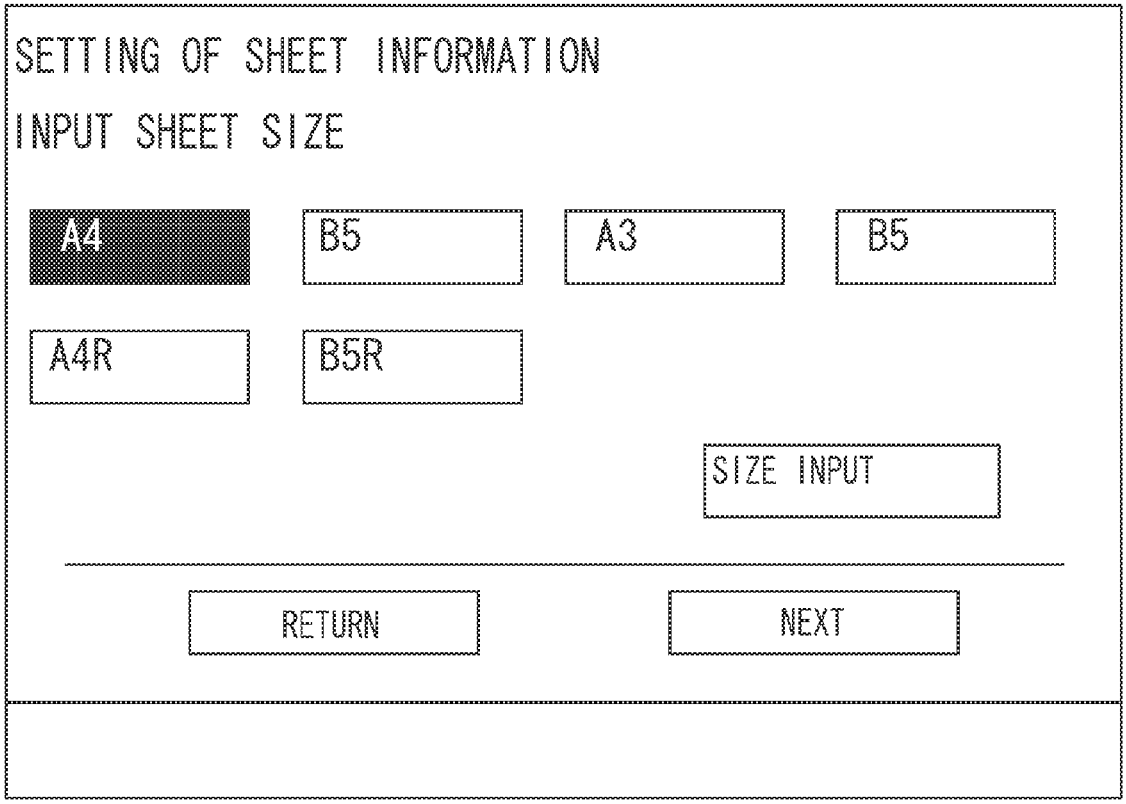
FIGS. 12A and 12B illustrate screens for setting sheets.
Figure 12B:
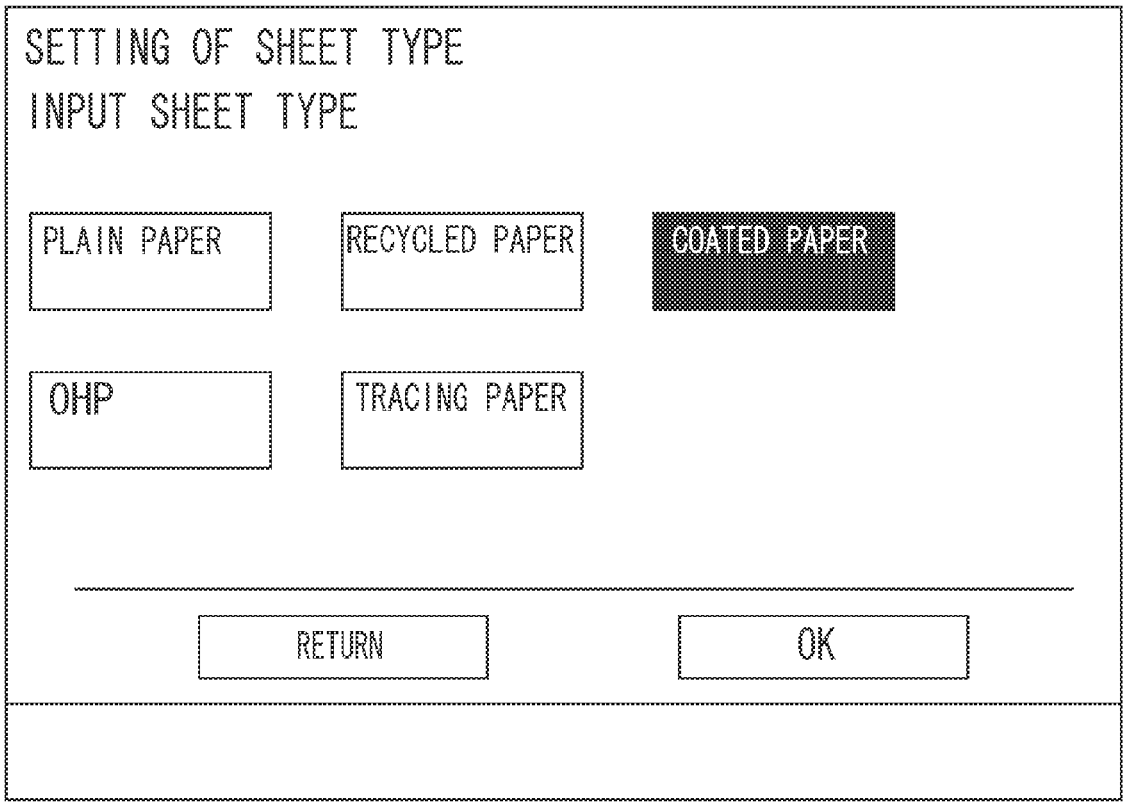

As illustrated in FIGS. 12A and 12B, the setting of the sheet size and the sheet material is performed for each sheet cassette by the operation display apparatus 400 and the set information is stored in the RAM 153. In other words, the CPU 151 and the operation display apparatus 400 function as an identification unit for identifying the material of a sheet.

When the stack mode is selected and then the start button 402 is depressed, the CPU 151 instructs the stacker control unit 801 to execute the selected stack mode and operate each unit such as the leading edge sheet positioning unit 823.

Figure 13:
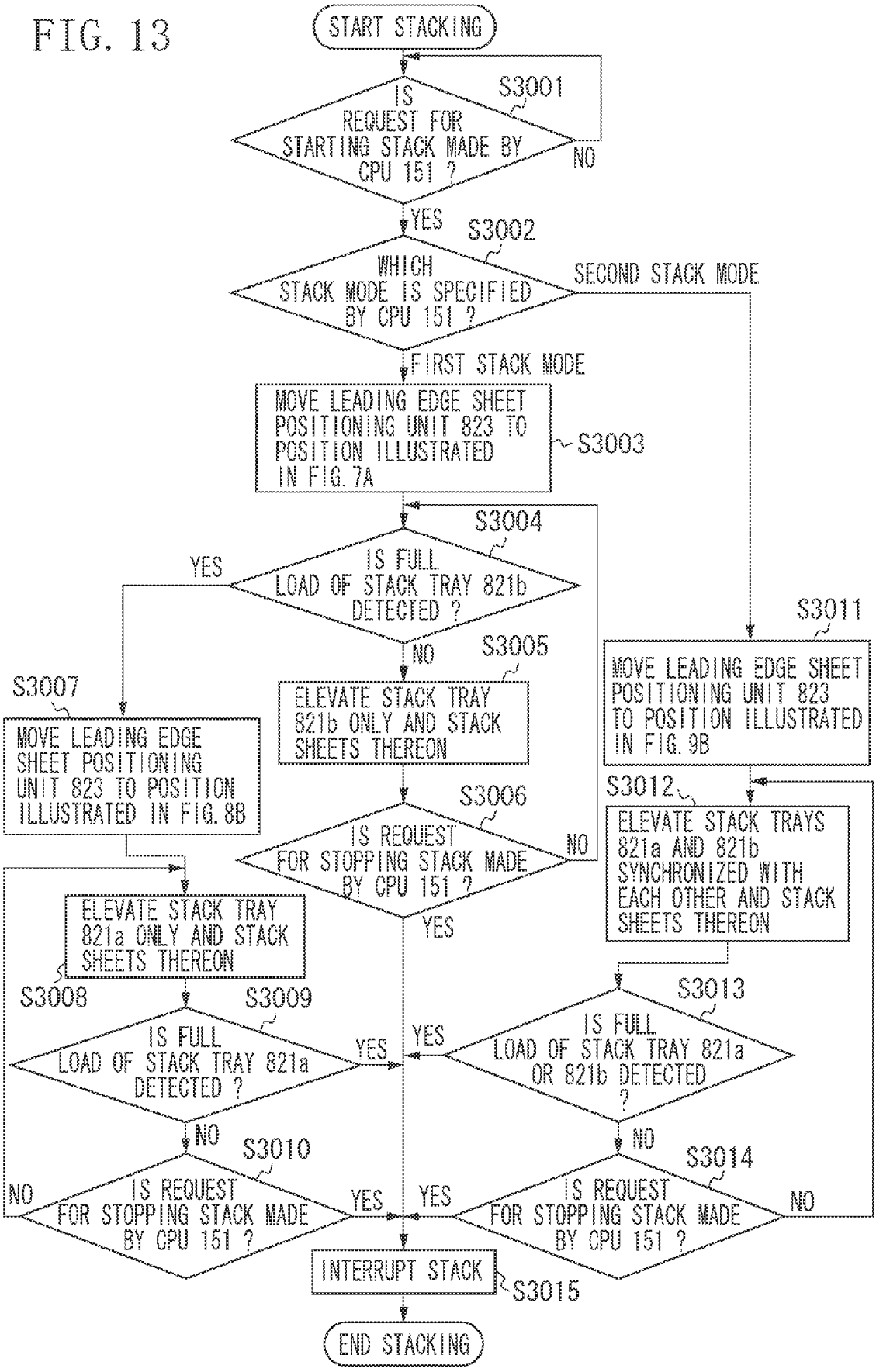
FIG. 13 is a flow chart illustrating control for stacking sheets.

The operation of the stacker control unit 801 executing the stack mode instructed by the CPU 151 is described below with reference to a flow chart in FIG. 13. Processing illustrated in the flowchart is executed by the stacker control unit 801.

In step S3001, the stacker control unit 801 determines whether the CPU 151 makes a request for starting stacking. If the CPU 151 makes the request (YES in step S3001), in step S3002, the stacker control unit 801 determines which stack mode is specified, the first or the second stack mode. If the specified stack mode is the first stack mode, then in step S3003, the stacker control unit 801 moves the leading edge sheet positioning unit 823 to a position illustrated in FIG. 7A. In step S3004, the stacker control unit 801 determines whether the full stack position detection sensor 817*b* detects the full load of stack tray 821*b*. If the full load of stack tray 821*b* is not detected (NO in step S3004), in step S3005, only the stack tray 821*b* is elevated to stack sheets thereon. In step S3006, the stacker control unit 801 determines whether the CPU 151 makes a request for stopping the stacking. If the CPU 151 makes the request for stopping (YES in step S3006), then in step S3015, the stacker control unit 801 interrupts the stacking of sheets. If the CPU 151 does not make the request for stopping (NO in step S3006), the stacker control unit 801 continues stacking the sheets on the stack tray 821*b* until the full load of the stack tray 821*b* is detected in step S3004.

If the full load is detected in step S3004 (YES in step S3004), then in step S3007, the stacker control unit 801 moves the leading edge sheet positioning unit 823 to a position illustrated in FIG. 8B. Then in step S3008, only the stack tray 821*a* is elevated to stack sheets thereon. In step S3009, the stacker control unit 801 determines whether the full stack position detection sensor 817*a* detects the full load of the stack tray 821*a*. If the full load is detected (YES in step S3009), then in step S3015, the stacker control unit 801 interrupts the stack operation. If the full load is not detected (NO in step S3009), in step S3010, the stacker control unit 801 determines whether the CPU 151 makes a request for stopping the stacking. If the request for stopping is made (YES in step S3010), in step S3015, the stacker control unit 801 interrupts the stack operation. Until the CPU 151 makes a request for stopping the stacking (NO in step S3010), the stacker control unit 801 elevates only the stack tray 821*a* and continues stacking sheets thereon.

In step S3002, if the stack mode specified by the CPU 151 is the second stack mode, then in step S3011, the stacker control unit 801 moves the leading edge sheet positioning unit 823 to a position illustrated in FIG. 9B. In step S3012, the stacker control unit 801 drives the tray elevating motors 841*a* and 841*b* with the motors synchronized with each other so that the height of the stack tray 821*a* is always maintained at the same height of the stack tray 821*b*. Then in step S3013, the stacker control unit 801 determines whether the full stack position detection sensors 817*a* or 817*b* detects that either the stack tray 821*a* or 821*b* is fully loaded. If the sensor detects the full load (YES in step S3013), then in step S3015, the stacker control unit 801 interrupts the stacking of sheets. If the sensor does not detect the full load (NO in step S3013), in step S3014, the stacker control unit 801 determines whether the CPU 151 makes a request for stopping the stacking. If the request for stopping is made (YES in step S3014), then in step S3015, the stacker control unit 801 interrupts the stacking of sheets. If the request for stopping is not made (NO in step S3014), the stacker control unit 801 continues stacking sheets on the stack trays 821*a* and 821*b* until the full load is detected.

According to the present exemplary embodiment, if the material of the selected sheet is coated paper, the second stack mode corresponding to "the preference for transportability" mode is selected even though "the preference for the number of sheets to be stacked" mode is set, so that the transportation of a heavy sheet bundle can be facilitated. Further, a load of the tray elevating motor is reduced, and a shortage of the torque of the motor can be avoided.

In the first exemplary embodiment, if the material of the selected sheet is coated paper, the second stack mode is selected without regard to the number of sheets to be stacked. In a second exemplary embodiment, a stack mode is selected in consideration of the number of sheets to be stacked. The selection of the stack mode in the second exemplary embodiment is described below.

Figure 14:
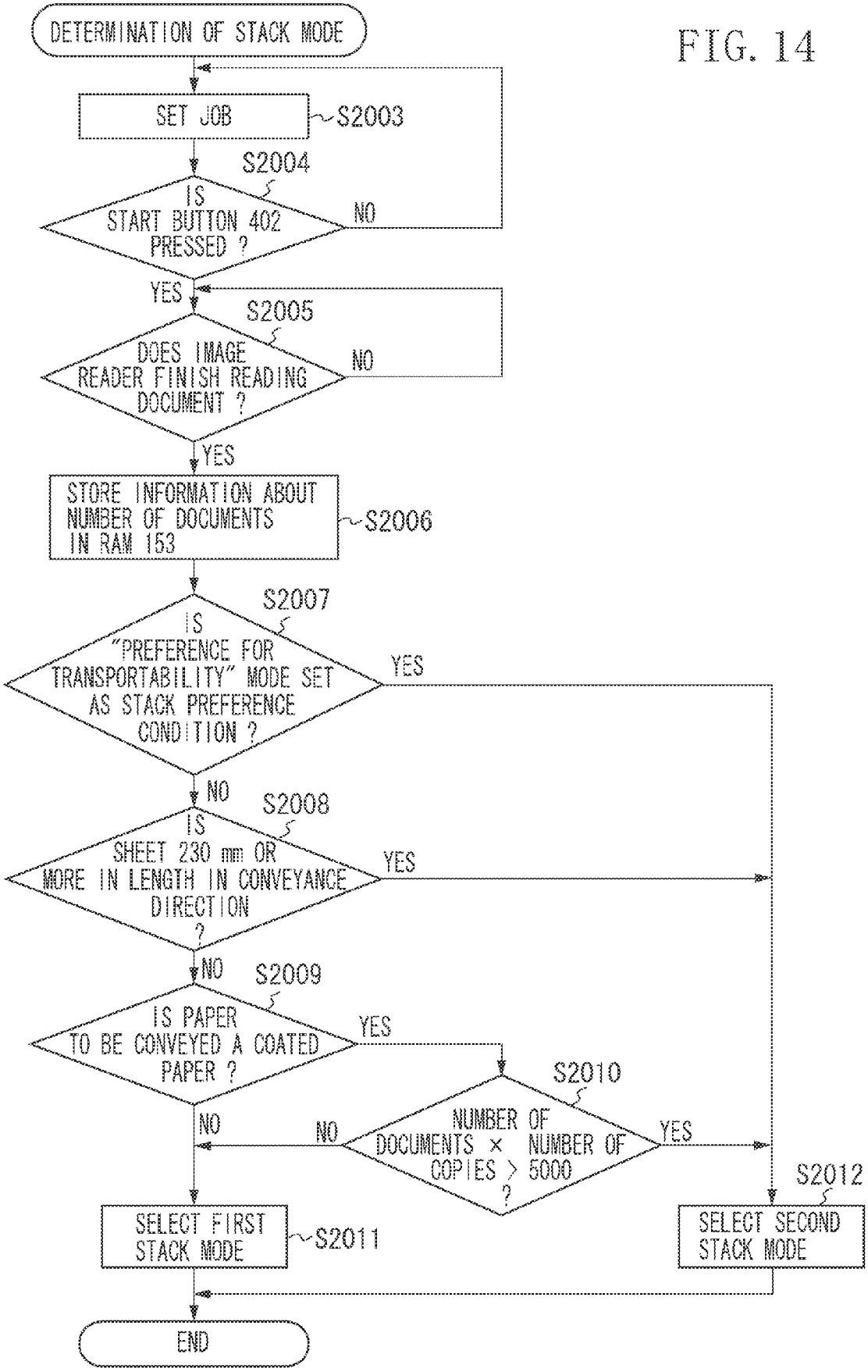
FIG. 14 is a flow chart illustrating control for determining a stack mode in a second exemplary embodiment.

FIG. 14 is a flow chart illustrating control in the determination of the stack mode in the second exemplary embodiment. Processing illustrated in the flow chart is executed by the CPU 151.

In step S2003, the CPU 151 determines the number of copies and setting of a job such as a two-sided mode which are set by a user and stores various pieces of information such as the set number of copies in the RAM 153. In step 2004, the CPU 151 determines whether the start button 402 is depressed by the user. If the start button 402 is depressed (YES in step 2004), then in step S2005, the CPU 151 instructs the document feeding apparatus 100 and the image reader 200 to start reading a document and determines whether the reading of the document is finished. If the reading of the document is finished (YES in step S2005), in step S2006, the CPU 151 stores information about the number of the documents read by the document feeding apparatus 100 and the image reader 200 in the RAM 153. In the present exemplary embodiment, although a document is read in the document flow reading manner by the document feeding apparatus 100, it is needless to say that a document may be read by a method without using the document feeding apparatus 100.

Figure 11:
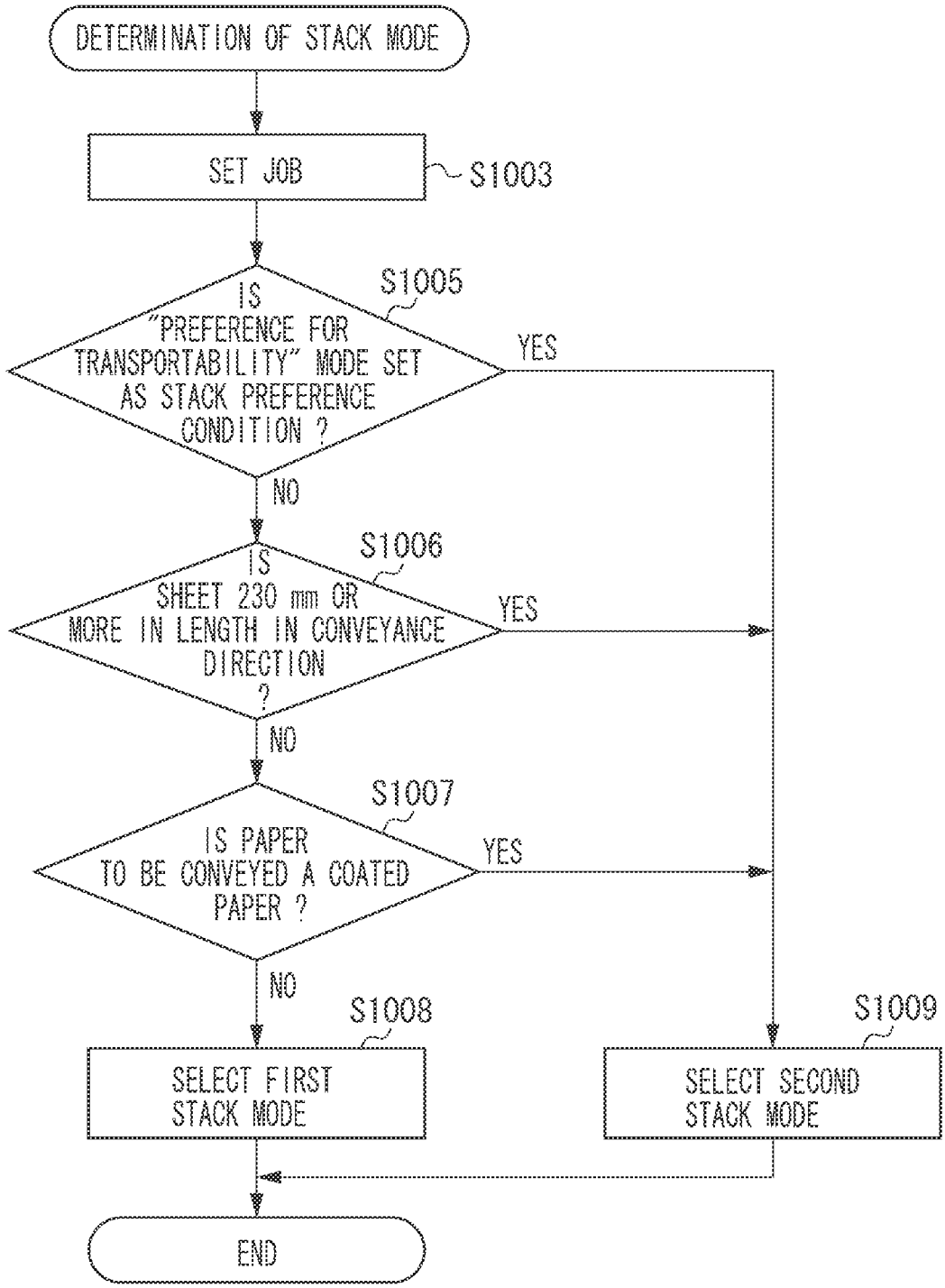
FIG. 11 is a flow chart illustrating control for determining a stack mode according to a first exemplary embodiment.

The processing in steps S2007, S2008, S2009, S2011, and S2012 are similar to those in steps S1005 to S1009 illustrated in FIG. 11 according to the first exemplary embodiment. The second exemplary embodiment is different from the first exemplary embodiment in that, in step S2009, if the CPU 151 determines that the material of a sheet is coated paper (YES in step S2009), the CPU 151 performs the processing in step S2010.

In step S2010, the CPU 151 determines whether the number of sheets to be stacked that can be obtained by multiplying the number of documents stored in the RAM 153 by the number of copies stored in the RAM 153 exceeds 5000. The value of 5000 sheets is a threshold at which the torque of the tray elevating motors 841*a* and 841*b* may be insufficient in stacking the coated paper on one tray. In other words, the value of 5000 sheets is determined according to the torque of the motors for elevating the first and the second tray and is different according to performance of the motor. If data from a computer is printed, the number of sheets to be stacked is determined from information about the number of pages included in a print job and the number of prints.

If the number of sheets to be stacked is 5000 or less (NO in step S2010), in step S2011, the CPU 151 selects the first stack mode as the stack mode. In other words, if the number of sheets of the coated paper to be stacked does not exceed the predetermined number of sheets, the torque of the tray elevating motor may be sufficient, so that the first stack mode is selected in accordance with the stack preference condition selected by the user. If the number of sheets to be stacked exceeds the predetermined number of sheets (e.g. 5000) (YES in step S2010), then in step S2012, the CPU 151 selects the second stack mode even if "the preference for the number of sheets to be stacked" mode is manually selected. In other words, if the number of sheets of the coated paper to be stacked exceeds the predetermined number of sheets, the second stack mode is selected to prevent occurrence of the insufficient torque of the tray elevating motor or difficulty in transportation of the sheets due to the weight. As is the case with the first exemplary embodiment, after the selection of the stack mode is completed, the CPU 151 instructs the stacker control unit 801 to execute the selected stack mode. The stacker control unit 801 stacks sheets according to the stack mode specified by the CPU 151 as is the case with the first exemplary embodiment.

The predetermined number of sheets used as a threshold in step S2010 is taken as 5000 sheets, but not limited to this value. The predetermined number of sheets may be determined as an appropriate value which is less than the number of sheets that can be stacked on one tray to an allowable height. For example, the predetermined number of sheets may be determined as the number of sheets in which the weight of a sheet bundle is equal to a predetermined weight within a range that the torque of the motor is sufficient.

In the first and the second exemplary embodiments, an operator can select the stack mode ("the preference for the number of sheets to be stacked" mode or "the preference for transportability" mode) via the operation unit. However, such a selection screen may be removed and the stacker control unit 801 or the CPU 151 may select the stack mode based on the material of the sheet and the number of sheets to be staked.

Figure 9C:
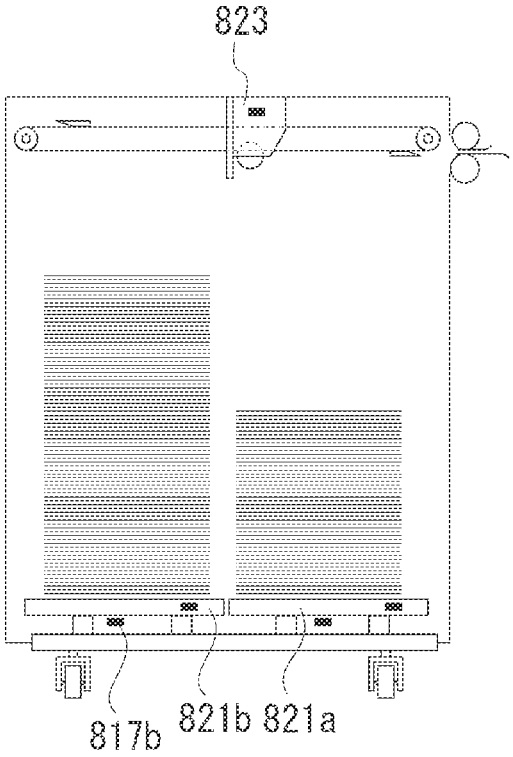

In the first and the second exemplary embodiments, if the torque of the motor may be insufficient when the coated paper is stacked in the first stack mode, the allowable height of sheets stacked on each tray can be made lower than a normal height to reduce the load on the motor. In this case, as illustrated in FIG. 9C, the height of sheets stacked on the tray 821*b* is lower than a normal height. If sheets stacked on the tray 821*a* are made nearly as tall as sheets stacked on the tray 821*b*, it will be easy for the operator to transport the sheets with the dolly.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-145447 filed Jun. 18, 2009, which is hereby incorporated by reference herein in its entirety.

What is claimed is:

1. A sheet stacking apparatus comprising:

a stack unit which includes a first stack tray and a second stack tray which can be individually elevated and is configured to stack a sheet on at least one of the first stack tray and the second tray; and a control unit configured to control the stack unit to stack sheets in a first stack mode in which sheets of a size equal to or smaller than a predetermined size are stacked on at least one of the first stack tray and the second stack tray without being extended over the first stack tray and the second stack tray and a second stack mode in which sheets of the size equal to the size of the sheets to be stacked in the first stack mode are stacked on across the first stack tray and the second stack tray, the control unit selects either the first stack mode or the second stack mode in a case where sheets of the size are stacked on the stack unit.

2. The sheet stacking apparatus according to claim 1, wherein an amount of sheets stacked in the first stack mode is greater than that in the second stack mode.

3. The sheet stacking apparatus according to claim 1, wherein the control unit selects one of the first stack mode and the second stack mode in accordance with an instruction from an operator.

4. The sheet stacking apparatus according to claim 1, wherein the control unit selects the second stack mode in a case where sheets of a size larger than the predetermined size are stacked on the stack unit.

5. A sheet stacking apparatus comprising:

a stack unit which includes a first stack tray and a second stack tray which can be individually elevated and is configured to stack a sheet on at least one of the first stack tray and the second tray;

a control unit configured to control the stack unit to stack the sheet in a first stack mode in which the sheet is stacked on at least one of the first stack tray and the second stack tray without being extended over the first stack tray and the second stack tray and a second stack mode in which the sheet is stacked on across the first stack tray and the second stack tray, the control unit capable of selecting the first stack mode and the second stack mode with respect to a same size sheet, wherein the control unit controls the first and the second stack modes in accordance with an instruction from an operator;

a dolly configured to be detachable from the sheet stacking apparatus and transport sheets stacked on at least one of the first stack tray and the second stack tray; and a selection unit configured to cause the operator to select either a preference for a multitude of the number of sheets to be stacked on the stack unit or a preference for transportability of sheets by the dolly;

wherein the control unit controls to select the first stack mode if the preference for a multitude of the number of sheets to be stacked is selected by the selection unit and determines to select the second stack mode if the preference for transportability is selected by the selection unit.

6. The sheet stacking apparatus according to claim 5, further comprising:

an obtaining unit configured to obtain a material of a sheet, wherein, if the material of the sheet obtained by the obtaining unit is a predetermined material which is equal to or more than a predetermined value in weight per unit thickness and unit area, the control unit controls to select the second stack mode even if the preference for a multitude of the number of sheets to be stacked is selected by the selection unit.

7. A sheet stacking apparatus comprising:

a stack unit which includes a first stack tray and a second stack tray which can be individually elevated and is configured to stack a sheet on at least one of the first stack tray and the second tray;

an obtaining unit configured to obtain a material of a sheet; and a control unit configured to control the stack unit to stack the sheet in a first stack mode in which the sheet is stacked on at least one of the first stack tray and the second stack tray without being extended over the first stack tray and the second stack tray and a second stack mode in which the sheet is stacked on across the first stack tray and the second stack tray, the control unit selecting the second stack mode if the material of the sheet obtained by the obtaining unit is a predetermined material which is equal to or more than a predetermined value in weight per unit thickness and unit area, and the first stack mode if the material of the sheet is not the predetermined material.

8. The sheet stacking apparatus according to claim 7, wherein, if the material of the sheet is the predetermined material and the number of sheets to be stacked on the stack unit is not greater than a predetermined number of sheets, the control unit controls to stack the sheet in the first stack mode.

9. The sheet stacking apparatus according to claim 8, wherein the predetermined number of sheets is the number of sheets previously determined according to capacity of a motor for elevating the first stack tray or the second stack tray.

10. The sheet stacking apparatus according to claim 7, wherein the control unit makes an allowable height to which the sheets are stacked on the stack unit in a case where the material of the sheet is the predetermined material lower than an allowable height in a case where the material of the sheet is not the predetermined material.

* * * * *